US011358209B2

(12) United States Patent
Suzuki et al.

(10) Patent No.: US 11,358,209 B2
(45) Date of Patent: Jun. 14, 2022

(54) METHOD FOR PRODUCING HOT FORGED MATERIAL

(71) Applicant: HITACHI METALS, LTD., Tokyo (JP)

(72) Inventors: Shogo Suzuki, Tokyo (JP); Tomonori Ueno, Tokyo (JP); Shinichi Kobayashi, Tokyo (JP); Shoichi Takahashi, Tokyo (JP); Takanori Matsui, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 151 days.

(21) Appl. No.: 16/650,296

(22) PCT Filed: Sep. 21, 2018

(86) PCT No.: PCT/JP2018/035215
§ 371 (c)(1),
(2) Date: Mar. 24, 2020

(87) PCT Pub. No.: WO2019/065543
PCT Pub. Date: Apr. 4, 2019

(65) Prior Publication Data

US 2020/0222969 A1 Jul. 16, 2020

(30) Foreign Application Priority Data

Sep. 29, 2017 (JP) ..... JP2017-190114

(51) Int. Cl.
*B21J 5/02* (2006.01)
*B21J 13/02* (2006.01)
(Continued)

(52) U.S. Cl.
CPC . *B21J 5/02* (2013.01); *B21J 1/06* (2013.01); *B21J 13/02* (2013.01); *C22C 19/057* (2013.01)

(58) Field of Classification Search
CPC ..... B21J 1/003; B21J 1/02; B21J 1/04; B21J 1/06; B21J 5/02; B21J 5/022; B21J 3/00; B21J 13/02; B21J 9/02; B21J 9/022
(Continued)

(56) References Cited

U.S. PATENT DOCUMENTS 4,740,354 A 4/1988 Watanabe et al.
7,469,568 B2 12/2008 Reissenweber
(Continued)

FOREIGN PATENT DOCUMENTS

CN 1488457 A 4/2004
CN 1500577 A 6/2004
(Continued)

OTHER PUBLICATIONS

"Communication with Supplementary European Search Report", EP Application No. 18860729.5, dated May 31, 2021, 8 pp.
(Continued)

*Primary Examiner* — Shelley M Self
*Assistant Examiner* — Katie L. Parr
(74) *Attorney, Agent, or Firm* — Myers Bigel, P.A.

(57) ABSTRACT

Provided is a method for producing a hot forged material capable of preventing the generation of double-barreling shaped forging defects. The method for producing a hot forged material, wherein both an upper die and a lower die are made of Ni-based super heat-resistant alloy and the method comprises a hot forging step of pressing a material for hot forging by the lower die and the upper die in the air to form the hot forged material, the method comprising: a raw material heating step of heating the material for hot forging in a furnace to a heating temperature within a range of 1025 to 1150° C.; a die heating step of heating the upper die and the lower die to a heating temperature within a range of 950 to 1075° C.; and a transferring step of transferring the
(Continued)

material for hot forging onto the lower die by a manipulator after the completion of the raw material heating step and the die heating step, wherein a value obtained by subtracting the heating temperature of the upper die and the lower die from the heating temperature of the material for hot forging is 75° C. or more.

4 Claims, 2 Drawing Sheets

(51) Int. Cl.
*C22C 19/05* (2006.01)
*B21J 1/06* (2006.01)

(58) Field of Classification Search
USPC ..... 72/342.7, 342.8; 148/559, 675
See application file for complete search history.

(56) References Cited

U.S. PATENT DOCUMENTS

| | | | |
|---|---|---|---|
| 11,072,841 | B2 | 7/2021 | Yang et al. |
| 2004/0084118 | A1 | 5/2004 | Raymond et al. |
| 2004/0221927 | A1 | 11/2004 | Raymond et al. |
| 2013/0174632 | A1 | 7/2013 | Hebert et al. |
| 2015/0013144 | A1 | 1/2015 | Bush et al. |
| 2016/0076116 | A1 | 3/2016 | Baettenhausen et al. |

FOREIGN PATENT DOCUMENTS

| | | | | |
|---|---|---|---|---|
| CN | 1319665 | C | 6/2007 | |
| CN | 101036931 | A | 9/2007 | |
| CN | 102873241 | A | 1/2013 | |
| CN | 102825189 | B | 4/2015 | |
| CN | 103302214 | B | 5/2015 | |
| CN | 107008841 | A | 8/2017 | |
| DE | 10354434 | A1 * | 6/2005 | ..... B21J 13/02 |
| EP | 0131175 | B1 | 6/1988 | |
| EP | 0460678 | A1 | 12/1991 | |
| JP | 61-127832 | U | 8/1986 | |
| JP | 62-50429 | A | 3/1987 | |
| JP | 63-21737 | B2 | 5/1988 | |
| JP | 3-174938 | A | 7/1991 | |
| JP | 5-261465 | A | 10/1993 | |
| JP | H06114483 | A | 4/1994 | |
| JP | 3227223 | B2 | 11/2001 | |
| JP | 2006-212690 | A | 8/2006 | |
| JP | 2016-68134 | A | 5/2016 | |
| JP | 2016-69703 | A | 5/2016 | |
| JP | 2016-529106 | A | 9/2016 | |
| JP | 2016-196026 | A | 11/2016 | |
| JP | 6045434 | B2 | 12/2016 | |

OTHER PUBLICATIONS

"Communication with Supplementary European Search Report", EP Application No. 18863051.1, dated Jun. 2, 2021, 7 pp.
English language translation of International Search Report, International Application No. PCT/JP2018/035215, dated Dec. 18, 2018, 2 pp.
Ohno et al., "Isothermal Forging of Waspaloy in Air with a New Die Material", Transactions of the Iron and Steel Institute of Japan, vol. 28, No. 11, 1988, pp. 958-964.
English language Translation of International Search Report, International Application No. PCT/JP2018/035214, dated Dec. 25, 2018, 2 pp.
Office Action and English language translation, JP Application No. 2019-539316, dated Aug. 29, 2019, 5 pp.
"First Office Action and English language translation", CN Application No. 201880063367.4, dated Feb. 1, 2021.
"First Office Action and English language translation", CN Application No. 201880063368.9, dated Feb. 1, 2021.
Ling, Guo , "Advanced Aeronautical Materials and Component Forging Technology", with English translation, Beijing: National Defense Industry Press, Nov. 2011, pp. 16-22.

* cited by examiner (a) EXAMPLE OF THE PRESENT INVENTION (b) COMPARATIVE EXAMPLE

METHOD FOR PRODUCING HOT FORGED MATERIAL

RELATED APPLICATIONS

This application is a 35 U.S.C. § 371 national stage application of PCT Application No. PCT/JP2018/035215, filed on Sep. 21, 2018, which claims priority from Japanese Patent Application No. 2017-190114, filed on Sep. 29, 2017, the contents of which are incorporated herein by reference in their entireties. The above-referenced PCT International Application was published in the Japanese language as International Publication No. WO 2019/065543 A1 on Apr. 4, 2019.

TECHNICAL FIELD

The present invention relates to a method for producing a hot forged material using a heated die.

BACKGROUND ART

In the forging of a heat-resistant alloy, a material for forging is heated to a predetermined temperature to reduce deformation resistance. The heat-resistant alloy has high strength even at a high temperature, and a hot forging die to be used in the forging is required to have high mechanical strength at a high temperature. When the temperature of a hot forging die in hot forging is approximately the same as room temperature, the workability of the material for forging decreases due to die chilling, and thus, a material with poor workability, such as Alloy 718 and Ti alloy, is forged by heating the material with the hot forging die. Consequently, the hot forging die should have high mechanical strength at a high temperature equal to or near the temperature to which the material for forging is heated. As a hot forging die that satisfies this requirement, Ni-based super heat-resistant alloys that can be used for hot forging at a die temperature of 1000° C. or more in the air are proposed (for example, see Patent Documents 1 to 3).

Hot forging applied to a poor workability material includes hot die forging in which a poor workability material is forged, for example, at a strain rate of about 0.01 to 0.1/sec by using a die heated to the temperature near that of the material for forging, and isothermal forging in which use of a die heated to the same temperature as the material for forging allows forging at a strain rate slower than that of hot die forging, for example, at a strain rate of 0.001/sec or less. As the hot forging performed in the air by using dies made of Ni-based super heat-resistant alloys proposed in Patent Documents 1 to 3, an example of isothermal forging is disclosed in Non-Patent Document 1 and an example of hot die forging is disclosed in Patent Document 4. Since forming the hot forged material to have a shape near the final shape allows to increase yield and decrease processing cost, isothermal forging in which no inhomogeneous deformation portion associated with die chilling through a die occurs on the hot forged material is advantageous in terms of forging material cost. In contrast, since lower temperature of a die increases high-temperature strength of the die and improves die life, hot die forging, in which die temperature is relatively low, is advantageous in terms of die cost. In the case in which forging conditions such as the strain rate that affects the structure of the hot forged material are within an acceptable range, the method having a lower manufacturing cost is selected from the choice of either hot die forging or isothermal forging, and the manufacturing cost is obtained by adding the equipment cost, the operation cost that depends on the number of forging steps, and the like, to the forging material cost and die cost.

REFERENCE DOCUMENT LIST

Patent Documents

Patent Document 1: JP S62-50429 A
Patent Document 2: JP S63-21737 B
Patent Document 3: U.S. Pat. No. 4,740,354 A
Patent Document 4: JP H03-174938 A

Non-Patent Document

Non-Patent Document 1: Transactions of the Iron and Steel Institute of Japan, Vol. 28 (1988), No. 11, pp. 958-964

SUMMARY OF THE INVENTION

Problem to be Solved by the Invention

When a Ni-based alloy such as Mar-M200, which is disclosed as a conventional alloy in Examples of Patent Document 2, is used for a die, the upper limit temperature of a typical die in the hot die forging of a poor workability material by using an actual machine is approximately 900° C., in terms of die life. A typical heating temperature for a poor workability material is 1000 to 1150° C., and the die temperature is lower than a material for hot forging by 100 to 250° C. A smaller temperature difference between a die temperature and a material for hot forging is more advantageous to make a hot forged material have a shape near the final shape, and the temperature difference with a material for hot forging can be lowered by applying a Ni-based super heat-resistant alloy that is excellent in high-temperature strength and advantageous in terms of die service life, as proposed in Patent Documents 1 to 3, to a die used in the hot die forging. In this case, the die temperature is required to be 950° C. or more, to achieve a sufficient effect of increasing the die temperature.

The temperature near the surface of a material for hot forging heated in a furnace decreases during transfer. When a material for hot forging in which temperature near the surface has decreased during transfer is placed on a lower die in a state in which the temperature difference between the material for hot forging and the die heating temperature is small, the temperature near the surface of the material for hot forging becomes lower than the die heating temperature. If the material for hot forging is hot forged in this state, near the top and bottom surfaces of the material for hot forging being in contact with the upper die and the lower die (a pair of an upper die and a lower die referred to as a "die") in hot forging is heated by the die to recover the temperature, whereas the temperature remains lowered at the side surface of the material for hot forging not being in contact with the die. If hot forging is performed under such a temperature variation, double-barreling shaped forging defects are highly likely to occur on the side surface of the hot forged material, since near the top and bottom surfaces of the hot forged material having relatively low deformation resistance are preferentially deformed. As used herein, the term top and bottom surfaces refer to a surface being in contact with an upper die and a surface being in contact with a lower die, respectively, in a material for hot forging. As used herein, the term double-barreling shaped forging defects refer to an elliptical concave at the side surface of a forging material caused by the generation of barreling portions near the top and bottom surfaces, and these barreling portions are generated by a material for hot forging protruding in a curved shape toward the outer periphery at the side surface of a forging material after forged by upset forging that is common to a cylindrical material for forging. The double-barreling shaped forging defect as used herein is shown in FIG. 1 with a hot forging step.

Typically, the generation of this forging defect increases the volume of a cut-off portion other than the final shape in a hot forged material, resulting in reduction of the yield.

The problem described above tends to be significant particularly when obtaining a large forging material. Thus, in the hot die forging in which a Ni-based super heat-resistant alloy excellent in high-temperature strength and advantageous in terms of die service life is applied to a die, the change of die material as well as the application of a production method in which no double-barreling shaped forging defect is generated are required.

As the first method to meet the above needs, the reduction of a surface temperature of a material for hot forging during transfer can be suppressed by shortening the transfer time. However, shortening of the transfer time has already been tried in a typical hot die forging at a die temperature of 900° C. or less. Thus, a study of a method other than the shortening of the transfer time is more effective.

Patent Document 4 discloses a hot die forging in which a material for forging is coated by a metal material having a melting point higher than the forging temperature. With this method, hot die forging is highly likely to be performed without generating any double-barreling shaped forging defects even at a die temperature of 950° C. or more. However, the method in Patent Document 4 requires a step of coating a material for hot forging before forging and a step of removing the coating after forging, resulting in reduction in productivity.

Therefore, there is still no proposal for a method for producing a hot forged material capable of preventing the generation of double-barreling shaped forging defects without reducing productivity in hot die forging, in which a die temperature is 950° C. or more.

It is an object of the present invention to provide a method for producing a hot forged material capable of preventing the generation of double-barreling shaped forging defects.

Means for Solving the Problem

The present inventors have studied the generation of double-barreling shaped forging defects in hot die forging in which a die temperature is 950° C. or more, and found that temperature conditions at which double-barreling shaped forging defects can be suppressed, thereby achieved the present invention.

That is, the present invention provides a method for producing a hot forged material, wherein both an upper die and a lower die are made of Ni-based super heat-resistant alloy and the method comprising hot forging step of pressing a material for hot forging by the lower die and the upper die in the air to form the hot forged material, the method comprising: a raw material heating step of heating the material for hot forging in a furnace to a heating temperature within a range of 1025 to 1150° C.; a die heating step of heating the upper die and the lower die to a heating temperature within a range of 950 to 1075° C.; and a transfer step of transferring the material for hot forging onto the lower die by a manipulator after the completion of the raw material heating step and the die heating step, wherein a value obtained by subtracting the heating temperature of the upper die and the lower die from the heating temperature of the material for hot forging is 75° C. or more.

The composition of the Ni-based super heat-resistant alloy is preferably, in mass %, W: 7.0 to 15.0%, Mo: 2.5 to 11.0%, and Al: 5.0 to 7.5%; as selective elements, Cr: 7.5% or less, Ta: 7.0% or less, Ti: 7.0% or less, Nb: 7.0% or less, Co: 15.0% or less, C: 0.25% or less, B: 0.05% or less, Zr: 0.5% or less, Hf: 0.5% or less, rare-earth elements: 0.2% or less, Y: 0.2% or less, and Mg: 0.03% or less; and the balance being Ni and inevitable impurities. A lower limit of a content of aforementioned selective elements includes 0%.

Before the material for hot forging is heated in the furnace to the heating temperature, a lubricating coating is preferably provided on the surface of the material for hot forging by application of a liquid lubricant.

Effects of the Invention

According to the present invention, the generation of double-barreling shaped forging defects can be prevented.

MODE FOR CARRYING OUT THE INVENTION

Figure 1:
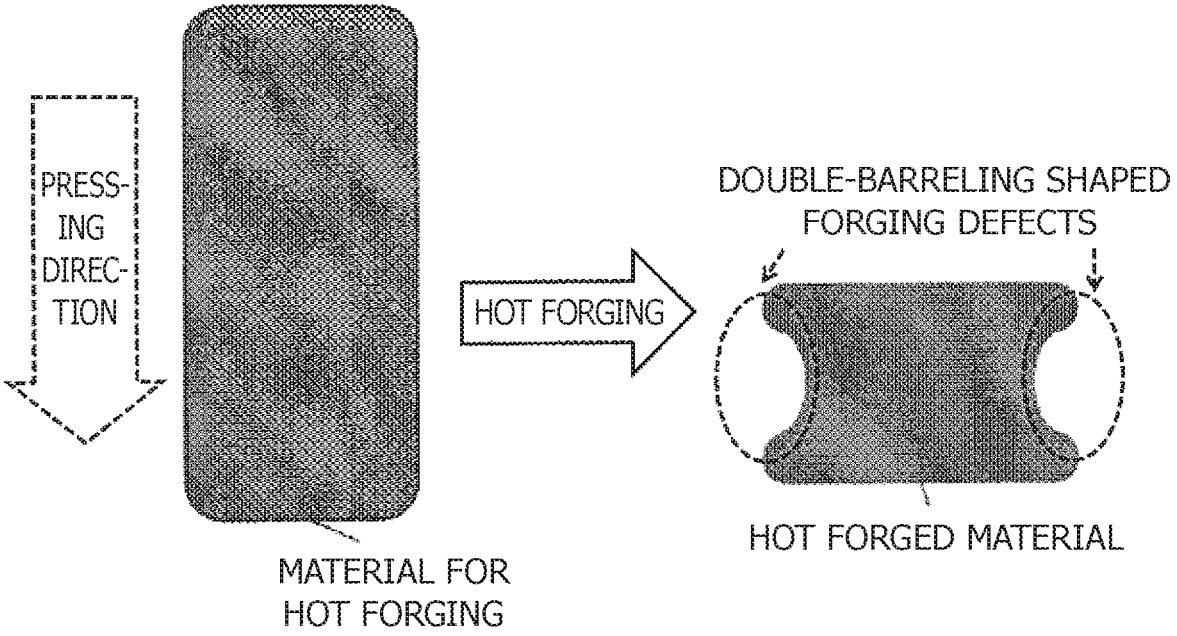
FIG. 1 is a diagram showing double-barreling shaped forging defects generated by hot forging.

The present invention will be described below in detail.

[Material for Hot Forging]

First, a material for hot forging used in a method for producing a hot forged material of the present invention will be described.

The present invention is suitable for producing a hot forged material of a material for hot forging composed of a poor workability material. Representative examples of the poor workability material include a Ni-based super heat-resistant alloy containing Ni as a main component and a Ti alloy containing Ti as a main component. As used herein, the term main component refers to an element having the highest content in mass %. The shape and the internal structure of the material for hot forging are not particularly limited, and are only required to be a shape and an internal structure typically suitable for a material for hot forging. As used herein, the term "Ni-based super heat-resistant alloy" refers to a Ni-based alloy also referred to as a superalloy and a heat-resistant superalloy and used in a high-temperature range of 600° C. or more, wherein the alloy is strengthened by precipitation phase such as γ'.

From the viewpoint of preventing the generation of double-barreling shaped forging defects, the shape of the material for hot forging according to the present invention preferably has a value of 3.0 or less and more preferably 2.8 or less, obtained by dividing the height of the material for hot forging when placing the raw material on a die by a maximum width (diameter) of the raw material. This is because, with this value higher than 3.0, other forging defects such as buckling are highly likely to occur, in addition to double-barreling shaped forging defects.

The surface of the material for hot forging may have a surface state on which a scale is formed, but a metal surface machined and thereafter degreased and cleaned is preferred to uniformly apply a lubricant.

In hot forging, the surface of the material for hot forging and a die come into contact with each other under high-temperature and high-stress loading conditions, and thus a lubricant or a release agent are used to reduce forming load, prevent seizing due to diffusion bonding between the die and the material for forging, suppress wear of the die, and the like. In the hot forging at a die temperature of 950° C. or more in the air, as in the present invention, a graphite-based lubricant, a boron nitride-based release agent, a glass-based lubricant and release agent, and the like are used as the lubricant or the release agent.

From the viewpoint of reducing forming load and application workability, a glass-based liquid lubricant obtained by dispersing a glass frit in a dispersing agent such as water is preferably used in the present invention. The glass frit is preferably borosilicate glass having a viscosity advantageous in terms of reducing forming load. From the viewpoint of suppressing a chemical reaction that promotes oxidation corrosion in the material for hot forging and the die, the content of an alkali component in the glass of this liquid lubricant is preferably as low as possible.

The glass-based liquid lubricant described above is imparted to the surface of the material for hot forging by, for example, spraying, brush coating, and applying by immersion onto the whole surface of the material for hot forging, or spraying and brush coating onto a die surface, and then it is supplied between the material for hot forging and the die. Among these, the application by spraying is most preferred as an application method, in terms of controlling the thickness of a lubricating film. The material for hot forging before the application of a lubricant may be heated to a temperature equal to or higher than room temperature before the application work to promote the volatilization of the dispersing agent such as water contained in the liquid lubricant.

The thickness of a glass-based lubricating film by application is preferably 100 μm or more to form a continuous lubricating film in forging. With a thickness of less than 100 μm, the lubricating film may be partially broken to cause a deterioration of lubricating ability due to direct contact between the material for hot forging and the die, and additionally, wear or seizing of the die may be likely to occur. From the viewpoint of suppressing temperature decrease during transfer, the thickness of a lubricating film is preferably as thick as possible. However, if a lubricating film has a thickness that is too thick, in a forging using a die having a complex shaped die face, the deviation from the dimensional tolerance of a forged product due to accumulation on the die face of glass may occur. Thus, the thickness of a lubricating film is preferably 500 μm or less.

[Die]

Next, the die to be used in the present invention will be described.

The material of the die to be used in the present invention is a Ni-based super heat-resistant alloy that is excellent in high-temperature strength and advantageous in terms of die service life. Examples of the material of the die excellent in high-temperature strength include fine ceramics and a Mo-based alloy, in addition to the Ni-based super heat-resistant alloy. However, a die made of fine ceramics is expensive. On the other hand, a die made of Mo-based alloy needs to be used under an inert atmosphere and thus requires large, special, dedicated facilities. Consequently, they are disadvantageous in terms of manufacturing cost, as compared with the Ni-based super heat-resistant alloy. For the above reasons, the material of the die to be used in the present invention is the Ni-based super heat-resistant alloy.

Among the Ni-based super heat-resistant alloy excellent in high-temperature strength, the Ni-based super heat-resistant alloy having an alloy composition described below is an alloy that is not only excellent in compressive strength at a high temperature, but also has a strength high enough to be used as a die for hot forging even in a high-temperature air atmosphere.

A preferred composition of the Ni-based super heat-resistant alloy for the hot forging die will be described below. The unit for the chemical composition is mass %. The preferred composition of the Ni-based super heat-resistant alloy is, in mass %, W: 7.0 to 15.0%, Mo: 2.5 to 11.0%, and Al: 5.0 to 7.5%; as selective elements, Cr: 7.5% or less, Ta: 7.0% or less, Ti: 7.0% or less, Nb: 7.0% or less, Co: 15.0% or less, C: 0.25% or less, B: 0.05% or less, Zr: 0.5% or less, Hf: 0.5% or less, rare-earth elements: 0.2% or less, Y: 0.2% or less, and Mg: 0.03% or less; and the balance being Ni and inevitable impurities.

[W: 7.0 to 15.0%]

W forms a solid solution in an austenitic matrix and also forms a solid solution in a gamma prime phase (γ' phase) basically composed of $Ni_3Al$ that is a precipitation strengthening phase to enhance the high-temperature strength of the alloy. Meanwhile, W has an effect of reducing the oxidation resistance and an effect of facilitating precipitation of a harmful phase such as the TCP (Topologically Close Packed) phase. From the viewpoint of enhancing the high-temperature strength and suppressing the reduction of the oxidation resistance and precipitation of a harmful phase, the content of W in the Ni-based super heat-resistant alloy according to the present invention is 7.0 to 15.0%. In order to more reliably achieve the effect of W, the lower limit is preferably 10.0%, the upper limit of W is preferably 12.0%, and the upper limit is further preferably 11.0%.

[Mo: 2.5 to 11.0%]

Mo forms a solid solution in an austenitic matrix and also forms a solid solution in a gamma prime phase basically composed of $Ni_3Al$ that is a precipitation strengthening phase to enhance the high-temperature strength of the alloy. Meanwhile, Mo has an effect of reducing the oxidation resistance. From the viewpoint of enhancing the high-temperature strength and suppressing the reduction of oxidation resistance, the content of Mo in the Ni-based super heat-resistant alloy according to the present invention is 2.5 to 11.0%. In order to suppress precipitation of a harmful phase such as the TCP phase associated with the addition of W and Ta, Ti, and Nb described below, the preferred lower limit of Mo is preferably set by taking into consideration the content of W and Ta, Ti, and Nb described below. In order to more reliably achieve the effect of Mo when containing Ta, the lower limit is preferably 4.0%, and the lower limit is further preferably 4.5%. The lower limit of Mo when no Ta, Ti, and Nb are added, is preferably 7.0%, and the lower limit is further preferably 9.5%. The upper limit of Mo is preferably 10.5, and the upper limit is further preferably 10.2%.

[Al: 5.0 to 7.5%]

Al has effects of binding to Ni to precipitate a gamma prime phase composed of $Ni_3Al$, enhancing the high-temperature strength of the alloy, producing an alumina film on the surface of the alloy, and imparting the oxidation resistance to the alloy. Meanwhile, an excess content of Al also has an effect of excessively producing a eutectic gamma prime phase, reducing the high-temperature strength of the alloy. From the viewpoint of enhancing the oxidation resistance and the high-temperature strength, the content of Al in the Ni-based super heat-resistant alloy according to the present invention is 5.0 to 7.5%. In order to more reliably achieve the effect of Al, the lower limit is preferably 5.5%, and the lower limit is further preferably 6.1%. The upper limit of Al is preferably 6.7%, and the upper limit is further preferably 6.5%.

[Cr: 7.5% or Less]

The Ni-based super heat-resistant alloy according to the present invention can contain Cr. Cr has effects of promoting the formation of a continuous layer of alumina on the surface of, or inside, the alloy and increasing the oxidation resistance of the alloy. In the hot die forging, which has a large dimensional tolerance of a hot forged material and a low die heating temperature as compared with the isothermal forging, the importance of the oxidation resistance is relatively low and the addition of Cr is not essential, and thus, Cr is added as needed in the Ni-based super heat-resistant alloy according to the present invention. When the addition of Cr is needed, the addition of Cr in a range more than 7.5% should be avoided, since it causes the reduction of the compressive strength of the alloy at 1000° C. or more. In order to reliably achieve the effect of Cr, the lower limit is preferably 0.5%, the lower limit is further preferably 1.3%, and the upper limit of Cr is preferably 3.0%.

[Ta: 7.0% or Less]

The Ni-based super heat-resistant alloy according to the present invention can contain Ta. Ta forms a solid solution by substituting into the Al site in a gamma prime phase composed of $Ni_3Al$, thereby enhancing the high-temperature strength of the alloy, and also has effects of enhancing the adhesion and the oxidation resistance of an oxide film formed on the surface of the alloy, and increasing the oxidation resistance of the alloy. In the hot die forging, which has a large dimensional tolerance of a hot forged material and a low die heating temperature as compared with the isothermal forging, the importance of the oxidation resistance and the high-temperature strength is low and the addition of Ta is not essential. In addition, Ta is expensive and a large addition leads to a high die cost. Thus, Ta is added as needed in the Ni-based super heat-resistant alloy according to the present invention. When the addition of Ta is needed, the addition in a range more than 7.0% should be avoided, since an excess content of Ta has an effect of facilitating precipitation of a harmful phase such as the TCP phase, and also has an effect of excessively producing a eutectic gamma prime phase to reduce the high-temperature strength of the alloy. In order to reliably achieve the effect of Ta, the lower limit is preferably 0.5%, and the lower limit is further preferably 2.5%. The upper limit of Ta is preferably 6.5%. When Ta is contained with Ti or Nb described below, too high total content of these elements causes the reduction of the high-temperature strength associated with precipitation of a harmful phase or excess production of a eutectic gamma prime phase, and thus, the total content of these elements is preferably 7.0% or less.

[Ti: 7.0% or Less]

The Ni-based super heat-resistant alloy according to the present invention can contain Ti. Ti forms a solid solution like Ta by substituting into the Al site in a gamma prime phase composed of $Ni_3Al$, thereby enhancing the high-temperature strength of the alloy. Ti is a low-cost element as compared with Ta and is advantageous in terms of die cost. In the hot die forging, which has a large dimensional tolerance of a hot forged material and a low die heating temperature as compared with the isothermal forging, the importance of the high-temperature strength is relatively low and the addition of Ti is not essential. Thus, Ti is added as needed in the Ni-based super heat-resistant alloy according to the present invention. When the addition of Ti is needed, the addition in a range more than 7.0% should be avoided, since an excess content of Ti has an effect of facilitating precipitation of a harmful phase such as the TCP phase, and also has an effect of excessively producing a eutectic gamma prime phase to reduce the high-temperature strength of the alloy. In order to reliably achieve the effect of Ti, the lower limit is preferably 0.5%, and the lower limit is further preferably 2.5%. The upper limit of Ti is preferably 6.5%. When Ti is contained with Ta described above or Nb described below, too high total content of these elements causes the reduction of the high-temperature strength associated with precipitation of a harmful phase or excess production of a eutectic gamma prime phase, and thus, the total content of these elements is preferably 7.0% or less.

[Nb: 7.0% or Less]

The Ni-based super heat-resistant alloy according to the present invention can contain Nb. Nb forms a solid solution like Ta and Ti by substituting into the Al site in a gamma prime phase composed of $Ni_3Al$, thereby enhancing the high-temperature strength of the alloy. Nb is a low-cost element as compared with Ta and advantageous in terms of die cost. In the hot die forging, which has a large dimensional tolerance of a hot forged material and a low die heating temperature as compared with the isothermal forging, the importance of the high-temperature strength is relatively low and the addition of Nb is not essential. Thus, Nb is added as needed in the Ni-based super heat-resistant alloy according to the present invention. When the addition of Nb is needed, the addition in a range more than 7.0% should be avoided, since an excess content of Nb has an effect of facilitating precipitation of a harmful phase such as the TCP phase, and also has an effect of excessively producing a eutectic gamma prime phase, reducing the high-temperature strength of the alloy. In order to reliably achieve the effect of Nb, the lower limit is preferably 0.5%, and the lower limit is further preferably 2.5%. The upper limit of Ti is preferably 6.5%. When Nb is contained with Ta or Ti described above, too high total content of these elements causes the reduction of the high-temperature strength associated with precipitation of a harmful phase or excess production of a eutectic gamma prime phase, and the total content of these elements is preferably 7.0% or less.

[Co: 15.0% or Less]

The Ni-based super heat-resistant alloy according to the present invention can contain Co. Co forms a solid solution in an austenitic matrix to enhance the high-temperature strength of the alloy. In the hot die forging, which has a large dimensional tolerance of a hot forged material and a low die heating temperature as compared with the isothermal forging, the importance of the high-temperature strength is relatively low and the addition of Co is not essential. Thus, Co is added as needed in the Ni-based super heat-resistant alloy according to the present invention. An excess content of Co increases a die cost, since Co is an expensive element as compared with Ni, and also has an effect of facilitating precipitation of a harmful phase such as the TCP phase. Thus, the addition in a range more than 15.0% should be avoided. In order to reliably achieve the effect of Co, the lower limit is preferably 0.5%, and the lower limit is further preferably 2.5%. The upper limit is preferably 13.0%.

[C and B]

The Ni-based super heat-resistant alloy according to the present invention can contain one or two elements selected from C and B. C and B increase the strength of the grain boundary of the alloy and enhance the high-temperature strength and the ductility. Thus, one or two elements selected from C and B are added as needed, in the Ni-based super heat-resistant alloy according to the present invention. An excess content of C and B causes the formation of a coarse carbide or boride and also has an effect of reducing the strength of the alloy. From the viewpoint of enhancing the strength of the grain boundary of the alloy and suppressing the formation of a coarse carbide or boride, the upper limit of the content of C is 0.25% and the upper limit of the content of B is 0.05% in the present invention. In order to reliably achieve the effect of C, the lower limit is preferably 0.005% and the lower limit is further preferably 0.01%. The upper limit is preferably 0.15%. In order to reliably achieve the effect of B, the lower limit is preferably 0.005%, and the lower limit is further preferably 0.01%. The upper limit is preferably 0.03%.

When cost efficiency or high-temperature strength is particularly needed, only C is preferably added, and when ductility is particularly needed, only B is preferably added. When both high-temperature strength and ductility are particularly needed, C and B are preferably added simultaneously.

[Other Optional Additional Elements]

The Ni-based super heat-resistant alloy according to the present invention can contain one or two or more elements selected from Zr, Hf, rare-earth elements, Y, and Mg. Zr, Hf, rare-earth elements, and Y segregate in a grain boundary of an oxide film formed on the surface of the alloy, which suppresses the diffusion of metal ions and oxygen at the grain boundary. This suppression of grain boundary diffusion reduces the growth rate of the oxide film and also changes the growth mechanism of promoting the spallation of the oxide film, which increases the adhesion between the oxide film and the alloy. That is, these elements have an effect of increasing the oxidation resistance of the alloy by reducing the growth rate of the oxide film and increasing the adhesion of the oxide film as described above.

In the alloy, S (sulfur), contained as an impurity, is not insignificant. This S reduces the adhesion of the oxide film through segregation to the interface between the oxide film formed on the alloy and the alloy as well as inhibition of their chemical bonding. Mg has effects of increasing the adhesion of the oxide film and increasing the oxidation resistance of the alloy by forming a sulfide with S and preventing the segregation of S.

Among the rare-earth elements, La is preferably used. This is because La has a large effect of increasing the oxidation resistance. La has, in addition to the effect of suppressing the diffusion as described above, an effect of preventing the segregation of S and excellent in the effect, and thus, among the rare-earth elements, La may preferably be selected. Since Y also has the same effect as La, Y is also preferably added, and two or more containing La and Y are particularly preferably used.

When in addition to the oxidation resistance, excellent mechanical property is needed, Hf or Zr is preferably used, and Hf is particularly preferably used. When Hf is added, Hf has a low effect of preventing the segregation of S, and so, the simultaneous addition of Mg in addition to Hf may further increase the oxidation resistance. Therefore, when both the oxidation resistance and the mechanical property are required, two or more elements containing Hf and Mg are further preferably used.

Since an excess amount of addition of the elements of Zr, Hf, rare-earth elements, Y, and Mg described above causes excess production of intermetallic compounds such as with Ni alloy, thereby reducing the toughness of the alloy. Thus, these optional additional elements are preferably set to a suitable content.

From the viewpoint of enhancing the oxidation resistance and suppressing the reduction of the toughness, the upper limit of the content of each of Zr and Hf in the present invention is 0.5%. The upper limit of the content of each of Zr and Hf is preferably 0.2%, further preferably 0.15%, and more preferably 0.1%. Since rare-earth elements and Y have a greater effect of reducing the toughness than Zr and Hf, the upper limit of the content of each of these elements according to the present invention is 0.2%, and the upper limit is preferably 0.1%, further preferably 0.05%, and more preferably 0.02%. When Zr, Hf, rare-earth elements, and Y are contained, the lower limit is preferably 0.001%. The lower limit that allows it to exhibit sufficient effects obtained by containing Zr, Hf, rare-earth elements, and Y is preferably 0.005%, and further preferably 0.01% or more.

Since only the amount required to form a sulfide with impurity S, which is contained in the alloy, may be contained in Mg, the content of Mg is 0.03% or less. The upper limit of Mg is preferably 0.02%, and further preferably 0.01%. In contrast, in order to more reliably exhibit the effect of adding Mg, the lower limit can be 0.005%.

The elements other than the additional elements described above are Ni and inevitable impurities. In the Ni-based super heat-resistant alloy according to the present invention, Ni is the main element for constituting a gamma phase and also constitutes a gamma prime phase together with Al, Ta, Ti, Nb, Mo, and W. As inevitable impurities, P, N, O, S, Si, Mn, Fe and the like are assumed to be contained. 0.003% or less of each of P, N, 0, and S may be contained, and 0.03% or less of each of Si, Mn, and Fe may be contained. The Ni-based alloy of the present invention can be referred to as a Ni-based heat-resistant alloy. Among the inevitable impurity elements, particularly S is preferably contained in an amount of 0.001% or less. In addition to the impurity elements described above, Ca is mentioned as an element that should be particularly limited. The addition of Ca to the composition defined in the present invention significantly reduces a Charpy impact value, and thus, the addition of Ca is to be avoided.

In addition, the shape of the die used in the present invention is not limited, and a shape corresponding to the shape of the material for hot forging or the hot forged material can be selected.

In the present invention, from the viewpoint of increasing the workability and the like, at least one surface of the forming surface or the side surface of a die can be a surface having a coating layer of an antioxidant, as needed. This prevents the oxidation of the die surface caused by the contact of oxygen in the air and a base material of the die at a high temperature and scattering of the scale associated therewith, allowing the deterioration in working environment and shape deterioration to be prevented. The antioxidant described above is preferably an inorganic material formed with any one or more of nitride, oxide, and carbide. This is for forming a dense oxygen blocking film by a coating layer formed by nitride, oxide, or carbide and for preventing the oxidation of a die base material. The coating layer may be a single layer of nitride, oxide, or carbide, or may be a lamination structure formed by combining any two or more of nitride, oxide, and carbide. Furthermore, a coating layer may be a mixture of any two or more of nitride, oxide, and carbide.

Next, "raw material heating step" and "die heating step" will be described. To prevent the double-barreling shaped forging defects described above, (1) heating temperature of material for hot forging, (2) heating temperature of die, and (3) temperature difference between these heating temperatures are very important.

The present inventors have studied the generation of double-barreling shaped forging defects in the hot die forging, in which a die temperature is 950° C. or more and found that the main cause of its generation is the preferential deformation near the bottom surface of the raw material during forging, caused by the temperature decrease near the surface of the material for hot forging during transfer and the heat recuperation near the bottom surface of the raw material by the die. Consequently, it is important to appropriately manage the (1) to (3) described above.

[Raw Material Heating Step]

Figure 2:
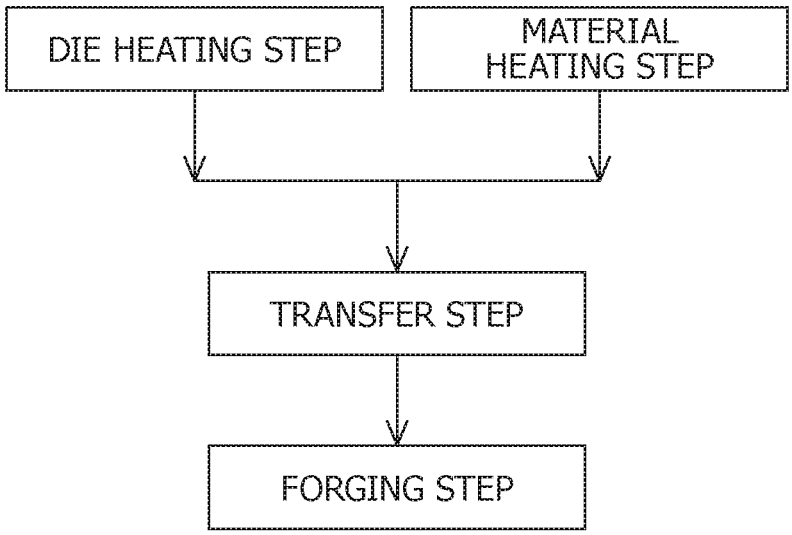
FIG. 2 is a diagram showing each step and flows of each step of a method for producing a hot forged material according to the present invention.

The material for hot forging described above is used and the material for hot forging is heated to a predetermined temperature. One example of the following step is illustrated in FIG. 2. Each of the die heating step and the raw material heating step may be performed simultaneously. However, the transfer step is performed after all of these steps have been completed, and the forging step is performed after this transfer step has been completed.

The material for hot forging is heated to an intended raw material temperature by using a furnace. In the present invention, the material for hot forging is heated to a heating temperature within a range of 1025 to 1150° C. in a furnace. By this heating, the temperature of the material for hot forging reaches the heating temperature. The heating time may be equal to or more than the time required for the whole material for hot forging to be heated to a uniform temperature. The lower limit of the heating temperature is set to relatively high temperature, 1025° C., in consideration of the temperature decrease near the surface of the material for hot forging during transfer to a hot forging machine (hot forming press machine). With a heating temperature less than 1025° C., double-barreling shaped forging defects are likely to occur. In contrast, with a temperature of more than 1150° C., a problem of coarsening of the metal structure of the material for hot forging is caused. The actual heating temperature may be determined in a range of 1025 to 1150° C. in accordance with the quality of the material for hot forging.

[Die Heating Step]

In the present invention, the die to be used in the hot forging is also heated to a heating temperature within a range of 950 to 1075° C. This heating allows the temperature of the die to be the heating temperature. At this time, the die made of the Ni-based super heat-resistant alloy having a preferred composition can be heated to an intended temperature in the air. The reason the heating temperature of the die is set to 950 to 1075° C. is, this temperature is needed to perform hot die forging and is to prevent double-barreling shaped forging defects. With the temperature out of the range of 950 to 1075° C., double-barreling shaped forging defects may occur. In heating of the die, at least the surface temperature of the pressing surface of the die may reach the intended temperature.

In addition, a value obtained by subtracting the heating temperature of the die from the heating temperature of the material for hot forging is set to 75° C. or more. When the material for hot forging is placed on the lower die with a state in which the temperature difference obtained by subtracting the heating temperature of the die from the heating temperature of the material for hot forging is 75° C. or less, the temperature near the surface of the material for hot forging becomes lower than the temperature of the die surface because of the temperature decrease during transfer. If forging is performed in this state, near the top and bottom surfaces of the material for hot forging is recovered during forging by the heat of the die, whereas the temperature near the surface of the side surface of the material for hot forging at which heat is not recovered is lowered as compared with the temperature near the bottom surface, causing temperature variation and the difference of deformation resistance associated therewith, preferentially deforming near the top and bottom surfaces with relatively low deformation resistance, and as a result, double-barreling shaped forging defects are generated. Thus, the generation of double-barreling shaped forging defects is prevented by setting the temperature difference obtained by subtracting the heating temperature of the die from the heating temperature of the material for hot forging to 75° C. or more and by intentionally providing the temperature difference between them, so that the temperature near the surface of the material for hot forging can be higher than the temperature of the die surface with the state that the material for hot forging is placed on the lower die.

In heating of the die, a method for transferring a die heated to a predetermined temperature in a furnace by induction heating, resistance heating, or the like to a hot forging machine, a method for heating a die to a predetermined temperature in a furnace, an induction heating device, a resistance heating device, or the like provided in a hot forging machine, or a combined method thereof may be used to achieve a predetermined temperature.

[Transfer Step]

After being heated to an intended temperature, the material for hot forging is transferred onto the lower die heated by a manipulator. Typically, as a manipulator used to transfer the material for hot forging, one having a pair of clamping fingers that holds the material for hot forging by clamping from the right and left and can hold and transfer a predetermined weight can be used. Also, in the present invention, a manipulator having a similar function is preferably used.

From the viewpoint of suppressing the generation of double-barreling shaped forging defects in transferring by the manipulator, a shorter transfer time is preferred. The generation of double-barreling shaped forging defects can be more reliably prevented by, in addition to the temperature difference conditions of the present invention, attaching a holding jig having a cover for covering the side surface of the material for hot forging to a clamp portion of the manipulator to suppress the temperature decrease during transfer.

[Hot Forging Step]

Hot forging is performed by using the material for hot forging and the die (the lower die and the upper die) heated to the predetermined temperature described above. Hot forging is performed by placing the material for hot forging on the lower die and pressing the material for hot forging in the air by the lower die and the upper die. This allows the obtaining of a hot forged material in which the generation of double-barreling shaped forging defects is prevented.

Examples

The present invention will be described in more detail by way of the following Examples.

Examples of Ni-based super heat-resistant alloys that are preferred as a die material used in the present invention will be shown. Each ingot of the Ni-based super heat-resistant alloys shown in Table 1 was produced by vacuum melting. The Ni-based super heat-resistant alloys each having a composition shown in Table 1 have an excellent high-temperature compressive strength property as shown in Table 2. Each of P, N, and O contained in the ingots shown in Table 1 was 0.003% or less. Each of Si, Mn, and Fe was 0.03% or less.

Each of P, N, and O contained in the ingots shown in Table 1 was 0.003% or less. Each of Si, Mn, and Fe was 0.03% or less.

The high-temperature compressive strength (compressive proof strength) shown in Table 2 was performed under conditions of a strain rate of $10^{-3}$/sec at 1100° C. Under these conditions, an alloy having 300 MPa or more can be considered to have sufficient strength as a die for hot forging. Among the compressive strength of the Ni-based super heat-resistant alloys shown in Table 2 each having a composition shown in Table 1, the highest value was 489 MPa, and the lowest value was 332 MPa. Thus, it was found that all of them have sufficient strength as the die for hot forging. No. 1 was tested also under the test conditions of a strain rate of $10^{-2}$/sec and a strain rate of $10^{-1}$/sec. The former value was 570 MPa, and the latter value was 580 MPa. It was demonstrated that the alloy has excellent compressive strength under the conditions of a relatively high strain rate. The high-temperature compressive strength of the compositions shown in Table 1 when used at a temperature of 1100° C. or less was higher than the values shown in Table 2.

Among the Ni-based super heat-resistant alloys shown in Table 1, an upper die and a lower die having the composition of No. 1 were produced as a representative example.

TABLE 1

| No. | Mo | W | Al | Cr | Ta | Ti | Nb | Co | Hf | Zr | La | Y | B | C | Mg | S | (mass %) Balance |
|---|---|---|---|---|---|---|---|---|---|---|---|---|---|---|---|---|---|
| 1 | 10.0 | 10.5 | 6.3 | — | — | — | — | — | — | — | — | — | — | — | — | <0.001 | Ni and inevitable impurities |
| 2 | 10.0 | 10.6 | 6.2 | 1.5 | — | — | — | — | — | — | — | — | — | — | — | 0.0002 | Same as above |
| 3 | 10.0 | 10.6 | 6.2 | 1.5 | 3.1 | — | — | — | — | — | — | — | — | — | — | 0.0002 | Same as above |
| 4 | 4.9 | 10.4 | 5.5 | 1.6 | 6.5 | — | — | — | — | — | — | — | — | — | — | 0.0002 | Same as above |
| 5 | 4.9 | 10.3 | 5.5 | 1.6 | 6.5 | — | — | — | 0.12 | — | — | — | — | — | — | 0.0003 | Same as above |
| 6 | 4.9 | 11.0 | 5.5 | 1.6 | 6.3 | — | — | — | — | — | — | — | — | — | 0.017 | 0.0002 | Same as above |
| 7 | 4.9 | 10.6 | 5.5 | 1.6 | 6.4 | — | — | — | 0.17 | — | — | — | — | — | 0.017 | 0.0002 | Same as above |
| 8 | 8.6 | 7.6 | 6.8 | 1.5 | 3.1 | — | — | — | — | — | — | — | — | — | — | 0.0003 | Same as above |
| 9 | 8.6 | 7.6 | 6.8 | 1.5 | 3.1 | — | — | — | 0.12 | — | — | — | — | — | — | 0.0003 | Same as above |
| 10 | 8.6 | 7.6 | 6.8 | 1.5 | 3.1 | — | — | — | — | 0.07 | — | — | — | — | — | 0.0003 | Same as above |
| 11 | 4.9 | 10.4 | 5.7 | 1.6 | 3.3 | 1.5 | — | — | 0.14 | — | — | — | | | 0.007 | 0.0002 | Same as above |
| 12 | 4.9 | 10.4 | 5.6 | 1.6 | 3.3 | — | 2.6 | — | 0.15 | — | — | — | — | — | 0.006 | 0.0003 | Same as above |
| 13 | 4.9 | 10.4 | 5.5 | 1.6 | 3.3 | 0.8 | 1.4 | — | 0.15 | — | — | — | — | | 0.002 | 0.0002 | Same as above |
| 14 | 2.7 | 13.3 | 5.5 | 1.6 | 3.2 | 1.5 | — | — | 0.15 | — | — | — | — | — | 0.006 | 0.0002 | Same as above |
| 15 | 2.6 | 13.4 | 5.4 | 2.2 | 3.2 | 1.5 | — | — | 0.15 | — | — | — | — | — | 0.006 | 0.0002 | Same as above |
| 16 | 2.7 | 13.5 | 5.7 | 1.5 | 3.2 | 1.5 | — | 5.0 | 0.15 | — | — | — | — | — | 0.006 | 0.0002 | Same as above |
| 17 | 2.6 | 13.4 | 5.8 | 1.6 | 3.2 | 1.5 | — | 12.5 | 0.16 | — | — | — | — | | 0.006 | 0.0002 | Same as above |
| 18 | 2.6 | 13.4 | 5.8 | 1.6 | 3.2 | 1.5 | — | 12.5 | 0.16 | — | — | — | 0.017 | — | 0.006 | 0.0002 | Same as above |
| 19 | 2.6 | 13.5 | 5.8 | 1.6 | 3.2 | 1.5 | — | 12.5 | 0.15 | — | — | — | — | 0.1 | 0.006 | 0.0003 | Same as above |
| 20 | 2.6 | 13.5 | 5.8 | 1.6 | 3.2 | 1.5 | — | 12.5 | 0.15 | — | — | — | 0.018 | 0.1 | 0.005 | 0.0003 | Same as above |

※ The symbol "—" means no addition.

TABLE 2

| No. | (MPa) |
|---|---|
| 1 | 460 |
| 2 | 376 |
| 3 | 489 |
| 4 | 406 |
| 5 | 332 |
| 6 | 396 |
| 7 | 400 |
| 8 | 390 |
| 9 | 421 |

TABLE 2-continued

| No. | (MPa) |
|---|---|
| 10 | 406 |
| 11 | 436 |
| 12 | 375 |
| 13 | 374 |
| 14 | 418 |
| 15 | 404 |
| 16 | 423 |
| 17 | 449 |
| 18 | 456 |
| 19 | 424 |
| 20 | 374 |

By using the die (the lower die and the upper die) made of Ni-based super heat-resistant alloy shown in No. 1 in Table 1, hot die forging was performed in the air at a die heating temperature of about 1000° C. and the heating temperature of the material for hot forging about 1100° C.

The material for hot forging was made of Ni-based super heat-resistant alloy and the high-temperature compressive strength of the material for hot forging was lower than the Ni-based super heat-resistant alloy shown in Table 1. The shape was a cylinder having a diameter of about 300 mm and a height of about 600 mm. The surface of the material for hot forging was machined, and a liquid-glass lubricant containing borosilicate glass frit was applied to the machined surface by brush coating, thereby coating the lubricant with a thickness of about 400 μm. Thereafter, the material for hot forging and the die were heated to predetermined temperatures.

After the temperature of the material for hot forging reached 1100° C. and the temperature of the die reached 1000° C., the heated material for hot forging was taken out from the furnace by using a manipulator placed on the lower die. Thereafter, hot die forging in which the material for hot forging is pressed by the lower die and the upper die was performed. The compression rate was about 70%, the strain rate was, since excess heat generation in the working is suppressed and the deformation resistance is relatively low, about 0.01/sec, and the maximum load was about 4000 tons. When the material for hot forging was placed on the lower die, the temperature near the surface of the material for hot forging was higher than the temperature near the die surface.

For comparison, hot die forging was performed in the same conditions except that the die heating temperature was set to 1040° C. When the die heating temperature was 1000° C., the difference between the temperature of the material for hot forging and the die heating temperature was about 100° C., and when the die heating temperature was 1040° C., the difference between them was about 60° C. When the material for hot forging of the comparative example was placed on the lower die, the temperature near the surface of the material for hot forging was lower than the temperature of the die surface.

Figure 3:
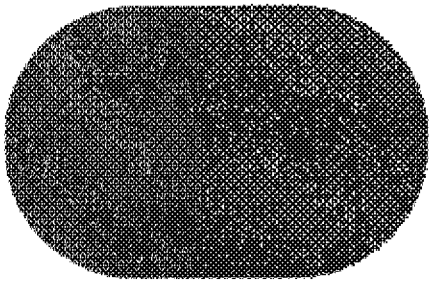
FIG. 3 is a diagram showing an effect of preventing double-barreling shaped forging defects by applying a method for producing a hot forged material according to the present invention.
Figure 3:
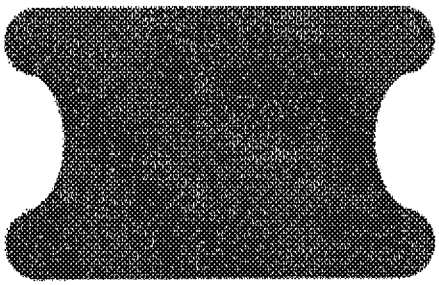

A conceptual diagram of the appearance of the hot forged material produced by the hot die forging under the conditions that the difference between the heating temperature of the material for hot forging and the heating temperature of the die was about 100° C. is shown in FIG. 3(*a*) as the present example, and a conceptual diagram of the appearance of the hot forged material produced under the conditions that the difference between the heating temperature of the material for hot forging and the heating temperature of the die was about 60° C. is shown in FIG. 3(*b*) as the comparative example.

The difference between the present example and the comparative example is only the die heating temperature, and the productivities of them are approximately equivalent. Nevertheless, as is apparent from FIGS. 3(*a*) and (*b*), the hot die forging to which the temperature conditions of the present invention are applied allow the obtaining of a hot forged material in which no forging defect is generated.

The invention claimed is:

1. A method for producing a hot forged material, wherein both an upper die and a lower die are made of Ni-based super heat-resistant alloy, the method comprising:

a raw material heating step of heating the material for hot forging in a furnace to a heating temperature within a range of 1025 to 1150° C.;

a die heating step of heating the upper die and the lower die to a heating temperature within a range of 1000 to 1075° C.; and a transferring step of transferring the material for hot forging onto the lower die by a manipulator after the completion of the raw material heating step and the die heating step; and a hot die forging step of pressing the material for hot forging by the lower die and the upper die in air to form the hot forged material, wherein a value obtained by subtracting the heating temperature of the upper die and the lower die from the heating temperature of the material for hot forging is 75° C. or more, and the lower die and the upper die have a high-temperature compressive strength of 300 MPa or more under conditions of a strain rate of $10^{-3}$/sec at 1100° C.

2. The method for producing a hot forged material according to claim 1, wherein the Ni-based super heat-resistant alloy has a composition comprising, in mass %, W: 7.0 to 15.0%, Mo: 2.5 to 11.0%, and Al: 5.0 to 7.5%; as selective elements, Cr: 7.5% or less, Ta: 7.0% or less, Ti: 7.0% or less, Nb: 7.0% or less, Co: 15.0% or less, C: 0.25% or less, B: 0.05% or less, Zr: 0.5% or less, Hf: 0.5% or less, rare-earth elements: 0.2% or less, Y: 0.2% or less, and Mg: 0.03% or less; and the balance being Ni and inevitable impurities.

3. A method for producing a hot forged material according to claim 1, wherein before the material for hot forging is heated in the furnace to the heating temperature, a lubricating coating is provided on a surface of the material for hot forging by application of a liquid lubricant.

4. The method for producing a hot forged material according to claim 1, wherein the Ni-based super heat-resistant alloy has a composition comprising, in mass %, W: 7.0 to 15.0%, Mo: 2.5 to 11.0%, Al: 5.0 to 7.5%, and Cr: 0.5 to 7.5%; as selective elements, Ta: 7.0% or less, Ti: 7.0% or less, Nb: 7.0% or less, Co: 15.0% or less, C: 0.25% or less, B: 0.05% or less, Zr: 0.5% or less, Hf: 0.5% or less, rare-earth elements: 0.2% or less, Y: 0.2% or less, and Mg: 0.03% or less; and the balance being Ni and inevitable impurities.

* * * * *